US005979490A

United States Patent [19]

Mirlisena, Sr.

[11] Patent Number: 5,979,490

[45] Date of Patent: Nov. 9, 1999

[54] ADJUSTABLE ANTI-FREEZE WATER DELIVERY ASSEMBLY

[76] Inventor: John Raymond Mirlisena, Sr., Cedar Pointe Village, 2929 SE. Ocean Blvd. I-5, Stuart, Fla. 34996-2778

[21] Appl. No.: 08/989,619

[22] Filed: Dec. 12, 1997

Related U.S. Application Data

[63] Continuation-in-part of application No. 08/426,280, Apr. 21, 1995, Pat. No. 5,697,393.

[51] Int. Cl.[6] ..... F16K 37/00; F16K 51/00

[52] U.S. Cl. ..... 137/369; 137/370; 137/301; 251/269

[58] Field of Search ..... 137/301, 368, 137/369, 370, 307; 251/268, 269

[56] References Cited

U.S. PATENT DOCUMENTS

| | | | |
|---|---|---|---|
| 544,410 | 8/1895 | Kottcamp | 137/369 |
| 954,437 | 4/1910 | Jacob | 137/369 |
| 961,178 | 6/1910 | Tyler | 137/369 |
| 2,687,141 | 8/1954 | Baker . | |
| 3,136,570 | 6/1964 | Lee . | |
| 3,188,120 | 6/1965 | Peterson . | |
| 3,586,019 | 6/1971 | Thomas | 251/268 |
| 3,858,599 | 1/1975 | Carlson | 137/307 |
| 3,971,401 | 7/1976 | Persson | 137/360 |
| 4,473,244 | 9/1984 | Hill | 137/360 |
| 4,475,570 | 10/1984 | Pike et al. | 137/360 |
| 4,662,389 | 5/1987 | Igbal | 137/360 |
| 4,932,686 | 6/1990 | Anderson, Jr. | 285/24 |
| 5,024,469 | 6/1991 | Aitken et al. | 285/302 |
| 5,697,393 | 12/1997 | Mirlisena, Sr. | 137/360 |
| 5,738,140 | 4/1998 | Mann | 137/369 |

*Primary Examiner*—A. Michael Chambers
*Attorney, Agent, or Firm*—Wood, Herron & Evans, LLP

[57] ABSTRACT

An adjustable anti-freeze water delivery assembly for connecting with a water main buried in the ground comprises a body section with an inner bore and a water outlet. A water supply section couples to a water main below the ground surface and has an inner bore wherein the body section and supply section are telescopically engaged for delivering water from the water main to the water outlet. A valve mechanism is movable between an open and a closed position to control water flow therethrough. A telescoping control stem extends between the body section and the valve mechanism for opening and closing the valve mechanism. The control stem is operable for telescoping in length when the assembly length is adjusted so that water is contained at a sufficient depth below the ground surface to reduce the possibility of freezing in the assembly.

10 Claims, 3 Drawing Sheets

ADJUSTABLE ANTI-FREEZE WATER DELIVERY ASSEMBLY

This application is a C-I-P of Ser. No. 08/426,280, filed Apr. 21, 1995, now U.S. Pat. No. 5,697,393.

FIELD OF THE INVENTION

This invention relates generally to anti-freeze water delivery assemblies, and specifically to adjustable anti-freeze water delivery assemblies.

BACKGROUND OF THE INVENTION

In-ground water delivery assemblies, that is, water delivery assemblies where a portion is buried in the ground, are installed for a variety of different purposes. For example, fire hydrants are installed for providing water to fight fires and are positioned proximate to various areas where they may be needed. Other hydrants or water faucets are installed for use on farms, golf courses, and residential or commercial landscaped areas which require readily available water sources.

In-ground water delivery assemblies generally utilize a hydrant or faucet body section which is mounted above a ground surface and provides the necessary water outlets and faucet handles or valve actuating structures for selectively turning the assemblies on and off to deliver water. Below the hydrant or faucet body section, the assemblies include connecting pipes or water supply sections which couple the body section directly to an underground water main for supplying water to the body section. The body section and water supply section include bores therein which form a continuous bore for directing water from the main to the outlets when the sections are assembled together. A valve mechanism is positioned within or proximate to the underground supply section and is selectively opened and closed for delivering water from the main, through the bore, and to the water outlets. The valve mechanism is thus buried below the ground surface. The water delivery assemblies include actuating devices which are operable for opening and closing the underground valve mechanisms. Generally, the actuating mechanism is accessible above ground and is coupled to the body section. The actuating device may include an elongated pump handle which pivots on the body section to open and close the valve mechanism. With respect to a fire hydrant, a threaded sleeve rotates within the hydrant body section and engages a valve stem to move the stem vertically to open and close the underground valve. The valve mechanisms themselves generally comprise a valve seat formed in one of the sections of the assembly and a rubber valve stop which is moved against the seat to close the valve mechanism and away from the seat to open the valve mechanism.

To prevent the water from freezing within an in-ground water delivery assembly, the underground supply sections and internal valve mechanisms are buried to a sufficient depth to keep the water out of the above-ground portion of the assembly. Generally, the underground valve mechanism is located proximate the end of the supply section which connects to the water main. In that way, the valve is in the deepest portion of the assembly and will contain the water therebehind and within the underground water main. Water will usually not be trapped within the above-ground hydrant or faucet body section to freeze when the outside temperature gets very cold.

For different climates and regions, water mains are buried and maintained at different depths. Therefore, anti-freeze water delivery assemblies, including hydrant assemblies and faucet assemblies, are made in a variety of different fixed lengths to maintain the valve of the assembly at a sufficient depth under the ground surface for use with a variety of different water main depths. For example, in more southern climates, the water mains may be buried approximately 30 inches below the ground surface. The underground supply section is then dimensioned to position the valve at approximately a 30-inch depth below the ground surface to connect with the main. For more northern climates, greater supply section lengths are necessary for positioning the valve sufficiently below the ground surface and out of a freezing zone for proper connection with the main, which will be buried deeper than mains in a more southern climate. The length of the assembly, including the underground supply section, will thus be determined by the climate and where the assembly is used. Generally, the length of the hydrant body section will be the same and is not affected by climate considerations or the depth of the water main.

Another factor considered when installing such water delivery assemblies, is the variation in the installation depth of the water main to which the assembly is to be attached. For example, water mains will be buried at various different depths along their length, and may slope upwardly and downwardly along their lengths so that one portion of the water main is buried slightly deeper than another, with the depth varying gradually along the length of the water main.

Current assemblies have various drawbacks from the standpoint of installation. Anti-freeze water delivery assemblies are made in a variety of different fixed lengths which are determined by the climate in which they are installed, and also the depth of the water main to which they are attached. To vary the lengths, the assemblies are made at those different lengths or extension kits are utilized and connected to a base assembly for changing the length. Generally, any length increases in the buried supply sections are done in fixed length increments either directly to the manufactured assembly or through extension kits at fixed lengths. The length increases are usually in 6 inch or 1 foot increments.

As may be appreciated, an installer is often faced with the situation wherein the installation depths vary widely, and not according to fixed increments. For example, one installation may require a buried section which positions the valve 30 inches below the ground surface, whereas another installation may require a buried section which positions the valve 40 inches below the ground surface. To further exacerbate the problem, such varying installations may be required along the same length of water main, such as a length of a water main running along a city street for hydrant hookup. Therefore, contractors, suppliers, and plumbers are required to maintain or order a relatively large inventory of anti-freeze water delivery assemblies or extension kits for the various different installation lengths. This practice is costly and undesirable, since such parts are heavy and bulky to handle.

As discussed above, such extension increments or kits are generally made in 6 inch to 1 foot increments and thus often do not provide the necessary length for proper installation. That is, the actual increment of adjustment is too long or too short for the installation. Therefore, even with a large inventory, all of the drawbacks are not eliminated. The only alternative is to use too much of an extension or too long of an assembly and to have the fire hydrant or faucet body section protrude above the ground surface further than normal. This causes an unsightly and undesirable installation. However, it is the only option because it is not practical (and oftentimes not possible) to try to vary the depth of the water main. It may be possible in certain situations to grade the ground level to provide a flush installation of the above-ground body section against the ground surface. However, in certain situations, and particularly those situations involving concrete sidewalks, such grading is not feasible.

Another drawback to currently existing anti-freeze water delivery assemblies is the fact that the required depth for a particular installation may be unknown until a suitable hole is dug to reach the water main. Therefore, an installer may not always have the ability to plan and choose the necessary assembly lengths for proper installation. As such, the installer would have to carry a large number of various assemblies or extension kits to the job site to be able to adjust to different installation conditions. For example, during the installation of ten fire hydrants, the installer will not know whether the ten fire hydrant assemblies must be the same length, or whether they will be ten different lengths, until the appropriate holes are dug to determine the actual depth of the water main below the ground surface.

Therefore, existing anti-freeze water delivery assemblies have various drawbacks and may not be suitable for the varying installation depths which an installer will experience. Furthermore, the additional inventory that is necessary to have a number of different lengths available for an installation is costly to maintain. Even if a large inventory is available, the fixed length increment will still not be suitable for all installations. Still further, the time and expense of making the proper installation when the length of the water delivery assembly does not match the depth of the underground water main may be prohibitive. Accordingly, various such installations are not done properly and oftentimes a portion of the underground assembly will be sticking out above the ground surface, which is not aesthetically appealing. This is particularly so when a fire hydrant projects substantially above a city sidewalk.

It is therefore an objective of the present invention to reduce the inventory which an installer must carry in order to install an anti-freeze water delivery assembly.

It is another objective of the invention to address the varying installation conditions for an anti-freeze water delivery assembly.

It is another objective of the present invention to provide an anti-freeze water delivery assembly which is easily and simply installed without extensive modifications to the assembly.

It is still another objective of the invention to provide an anti-freeze water delivery assembly which may be installed properly each time without having to vary the grade of the ground surface of the installation.

It is another objective of the invention to maintain the position of the valve at a sufficient depth below the ground surface for use at a variety of different depths.

It is still another objective of the invention to provide an anti-freeze water delivery assembly which may be installed relatively quickly and inexpensively, and is suitable for use with water mains having various different depths.

SUMMARY OF THE INVENTION

The above-discussed objectives, and other objectives are achieved by the present invention which includes an adjustable anti-freeze water delivery assembly which may be easily and readily adjusted to a different length to address varying installation conditions and installation depths. The inventive assembly may be installed properly each time without concern for varying installation depths which do not fall within a particular incremental range. Furthermore, the inventive assembly maintains the position of the valve at a sufficient depth below the ground surface to prevent freezing while effectively reducing or eliminating the need for drastically grading the ground surface proximate the installation.

To that end, the inventive anti-freeze water delivery assembly of the invention includes a body section which has an inner bore and at least one water outlet in communication with the bore. For example, the body section may be a conventional fire hydrant section having multiple water outlets, or a faucet-type body section having a single outlet. The body section is configured for being mounted generally above a ground surface. The water supply section of the assembly is configured for being buried and coupling to the water main below the ground surface and also has an inner bore. The body section and supply section are telescopically engaged for delivering water from the water main through the bores into the water outlet in the body section. The water supply section and body section are operable for telescoping to selectively vary the length of the overall assembly. In that way, the assembly may be utilized for installations at a variety of different depths. Preferably, a dynamic seal structure is positioned between the body section and water supply section for sealing the telescoping bores and containing the water within the telescoping bores. The dynamic seal structure allows the assembly to be readily telescoped to a variety of different lengths while maintaining the proper water seal. Alternatively, another sealing structure may be utilized for fixing the length of the telescoping assembly once it has been adjusted to the desired length.

A valve mechanism, comprising a valve seat and a valve stop which is movable against the seat, is positioned proximate the supply section bore. The valve mechanism is preferably positioned within the bore, generally proximate the deepest end of the supply section. In that way, the valve mechanism is maintained at a sufficient depth to prevent the water behind the valve mechanism from freezing. The valve mechanism is movable between an opened and a closed position to control water flow through the bores. In an open position, the valve stop is moved away from the seat to allow water to pass through the valve mechanism and through the bores to the water outlet. In a closed position, the valve stop is pressed against the valve seat to form a watertight seal.

For adjusting to a variety of different assembly lengths, the inventive water delivery assembly includes a telescoping control stem which extends between the body section and the valve mechanism and is coupled to the valve mechanism for opening and closing the valve mechanism. The control stem is operable for telescoping in length when the assembly length is adjusted to maintain the valve mechanism proximate the deepest end of the supply section. Therefore, when the valve mechanism is closed, the water is contained at a sufficient depth below the ground surface to reduce the possibility of freezing in the assembly. In a fire hydrant embodiment of the invention, a nut structure is rotatably coupled with said body section and includes a threaded bore which engages a threaded end of the control stem. Rotation of the nut structure in the body section, such as with a wrench, operably translates the stem through the threaded bore to move the valve stop and open and close the valve mechanism. In a faucet-type assembly, a hand lever is hingedly attached to the body section and is coupled to the control stem. When the hand lever is hinged up or down, the control stem is translated and the valve mechanism is opened or closed accordingly to control the flow of water through the assembly.

A preferred embodiment of the telescoping control stem includes two telescoping portions which are slideably coupled together. A securement structure is coupled between the telescoping portions to secure the portions together at a desired length once the length of the assembly is determined. In one embodiment, one stem portion slides inside another portion and both of the telescoping stem portions include holes therethrough which align at predetermined stem lengths. The securement structure includes a pin which is positioned in the aligned holes to effectively fix the length of the stem at a desired length. Preferably, the predetermined stem length increments are small, such as 1 inch increments, and therefore provide a wide range of precise stem length adjustments for a particular assembly.

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

Figure 1:
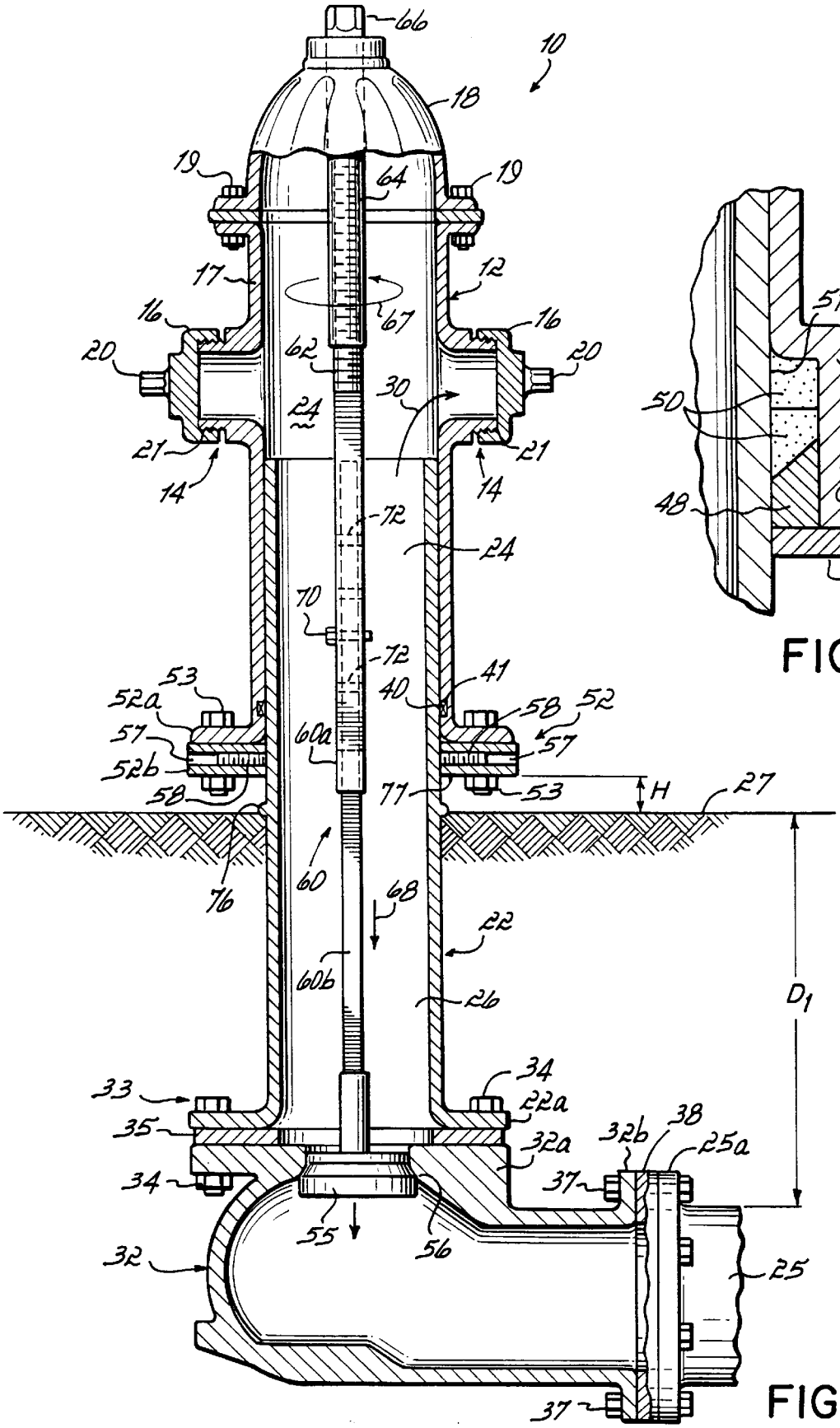
FIG. 1 is a side view, in partial cross-section, of one embodiment of the adjustable anti-freeze water delivery assembly of the invention shown at a first installation depth.

FIG. 1 shows one embodiment of the inventive water delivery assembly 10 which is in the form of a fire hydrant water delivery assembly. Assembly 10 includes a body section 12 which is shaped like a conventional fire hydrant, having a number of water outlets 14 which are covered by caps 16. Generally, a hydrant body section 12 will include a number of different pieces such as the main body piece 17 which is connected to a cap piece 18 by appropriate fasteners, such as bolts 19. The water outlet caps 16 include nipples 20 which may be engaged by a wrench for unscrewing the caps which may be coupled to piece 17 by threads 21. Depending upon the number of hoses to be connected to the hydrant assembly 12, one or more of the caps 16 may be removed. Alternatively, the hydrant assembly 12 might include a single cap 16. The overall length of the body section 12 is preferably around 32 inches. In accordance with the fire codes and ASTM standards, the outlets are preferably sized properly so that one hydrant handles various types and sizes of hoses.

In accordance with the principles of the present invention, the body section 12 telescopically engages a water supply section 22. As illustrated in FIG. 1, the body section 12 is generally elongated as is the water supply section 22. The body section 12 includes an internal bore 24 and the water supply section 22 also includes an internal bore 26. When the body section 12 and supply section 22 are telescoped together, the bores 24, 26 are in alignment and water from a water main 25 buried below the ground surface 27 travels up through the cooperating bores 24, 26 and through the water outlet as indicated by reference arrow 30. Since the hydrant assembly 10 will generally be oriented vertically and perpendicular to the ground surface as shown by numeral 27, and the water main 25 will generally be buried in the ground and positioned horizontally and generally parallel to the ground surface 27, the assembly 10 will include a transition section 32, often referred to as a shoe fitting, which is coupled to the deepest end 33 of section 22. Sections 22 and 32 are coupled together by appropriate fasteners, such as bolts 34 which extend through annular flanges 22*a* and 32*a*. Sandwiched between the annular flanges is a gasket 35 to ensure watertight seal between section 22 and section 32. Section 32 includes a 90° bend, as illustrated in FIG. 1, and provides suitable coupling between the horizontal water main 25 and the vertical body section 12 and water supply section 22. Section 32 will generally be from 6–8 inches long. The other end of section 32 includes another annular flange 32*b* which couples to the water main flange 25*a* with appropriate fasteners such as bolts 37. A gasket or seal 38 is also preferably positioned between the flanges 25*a* and 32*b* to ensure a watertight seal between the sections 22, 32.

To ensure a watertight seal between the telescoping sections 12, 22 a dynamic seal structure 40 is positioned within an appropriately formed recess 41 formed in the hydrant body section 12. The dynamic seal structure 40, as shown in FIG. 1, is thus positioned between an inner surface of the hydrant body section 12, and an outer surface of the water supply section 22 to form a watertight seal between the two sections. In a preferred embodiment of the invention, the dynamic seal mechanism 40 is a circular gasket or sealing ring, such as an O-ring, which encircles the water supply section 22. Dynamic seal 40 is configured to allow free telescopic movement of the body section 12 and supply section 22, but is constructed to maintain a watertight seal when the various sections are telescoped to the desired length.

Figure 1A:
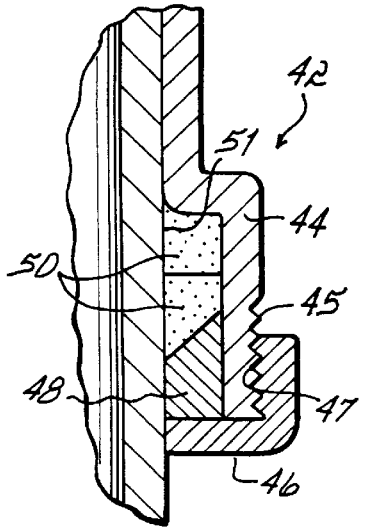
FIG. 1A is an enlarged cross-sectional view of a sealing structure for the alternative embodiment of the invention.

In an alternative embodiment of the invention, as illustrated in FIG. 1A, the dynamic seal structure 40 might be replaced with an alternative sealing structure such as a packing gland 42. Packing gland 42 includes a seal seat section 44 formed with threads 45 and appropriately connected to the lower end of body section 12. A rotating cap section 46 with corresponding threads 47 rotates to tighten down upon seat section 44 to compress a wedge gasket 48 against one or more sealing gaskets 50. This, in turn, compresses the sealing gaskets 50 between the seat 44 and the outer surface 51 of the supply section 22. Packing gland 42 forms a watertight seal between the supply section 22 and body section 12 to prevent leakage. The packing gland 42 also acts to generally fix the two sections together once they have been adjusted to the desired length.

To secure the telescoping body section 12 and supply section 22 together once the entire assembly has been adjusted to the desired length, a locking retainer mechanical flange assembly 52 might be utilized. The flange assembly 52 includes opposing annular collars 52*a*, 52*b* which are held together by appropriate fasteners such as bolts 53. The collar 52*a* is preferably part of body section 12. The collar 52*b*, on the other hand, is a separate piece and is fixed to the supply section 22. Referring to FIG. 1, collar 52*b* is configured to slide over the outside of body section 22. Collar 52*b* has a plurality of threaded bores 57 formed therein for receiving set screws 58. The set screws 58 are tightened in the bores 57 against the outside surface of the supply section 22 to lock the collar 52*b* in position on the supply section. Then, when the collars 52*a*, 52*b* are secured together, the length of the assembly will be generally fixed. A gasket or other seal (not shown) may be positioned between the collar 52*b* and the outside surface of section 22.

The valve mechanism of the present invention is positioned proximate the supply section bore, and more specifically, proximate the bottom end of the supply section. The valve mechanism includes a rubber valve stop 55 which fits, in a compression friction fit, into a valve seat 56 formed proximate the end of the supply section 22. In the embodiment illustrated in FIG. 1, the valve seat is formed in the transition section 32. Alternatively, the valve seat might be formed integrally with the end of the supply section 22. The rubber valve stop 55 is raised and lowered by a control stem 60. The control stem 60 in the hydrant assembly 10 has a plurality of threads 62 at its upper end, and the upper end of the control stem is received within a threaded sleeve 64 coupled to a nut structure 66 extending through the cap piece 18. Therefore, the nut structure is accessible outside of the hydrant body section 12. The nut structure 66 and sleeve 64 are rotatably mounted within the cap piece 18 and thus may be rotated within the cap piece such as by applying a wrench to the nut structure and rotating it, as illustrated by a reference arrow 67 in FIG. 1. Rotation of sleeve 64 moves the control stem 60 vertically, as illustrated by reference arrow 68. To open the valve, nut structure 66 and sleeve 64 are rotated in one direction so that the valve stop 55 is moved vertically downward to become unseated from valve seat 56 and thus provide an opening for the passage of water through the valve seat 56 and through the cooperating bores 24,26. Rotating sleeve 64 in the opposite direction will draw the valve stop 55 back into seat 56 and stop the flow of water through the bores. In that way, the valve mechanism is selectively opened and closed for selectively delivering water through the hydrant assembly 10. As understood by a person of ordinary skill in the art, the valve mechanism may be constructed to open when the valve stop is moved up and closed when the valve stop is moved down.

In accordance with the principles of the present invention, the assembly 10 may be adjustable in length by adjusting the telescoping body section 12 and supply section 22. Control stem 60 of assembly 10 telescopes in length when the assembly length is adjusted so that the maintain the valve mechanism 55, 56 may be maintained proximate the deepest end of the supply section. In that way, when the valve mechanism is closed, water is contained within the main 25 and within transition section 32 at a sufficient depth below the ground surface 27 to reduce the possibility of freezing within the assembly 10. In a preferred embodiment of the invention, the telescoping sections 60*a*, 60*b* of the control stem 60 are coupled together by a pin 70. Each of the control stem sections 60*a*, 60*b* include a plurality of generally horizontal passages formed therethrough which may be aligned when the control stem is telescoped to its desired length. That is, the control stem is adjusted to a desired length and then the corresponding passages 72 of each of the sections 60*a*, 60*b* are aligned so that the pin 70 may fit therethrough and couple the sections 60*a*, 60*b* together to form the unitary control stem 60.

Figure 2:
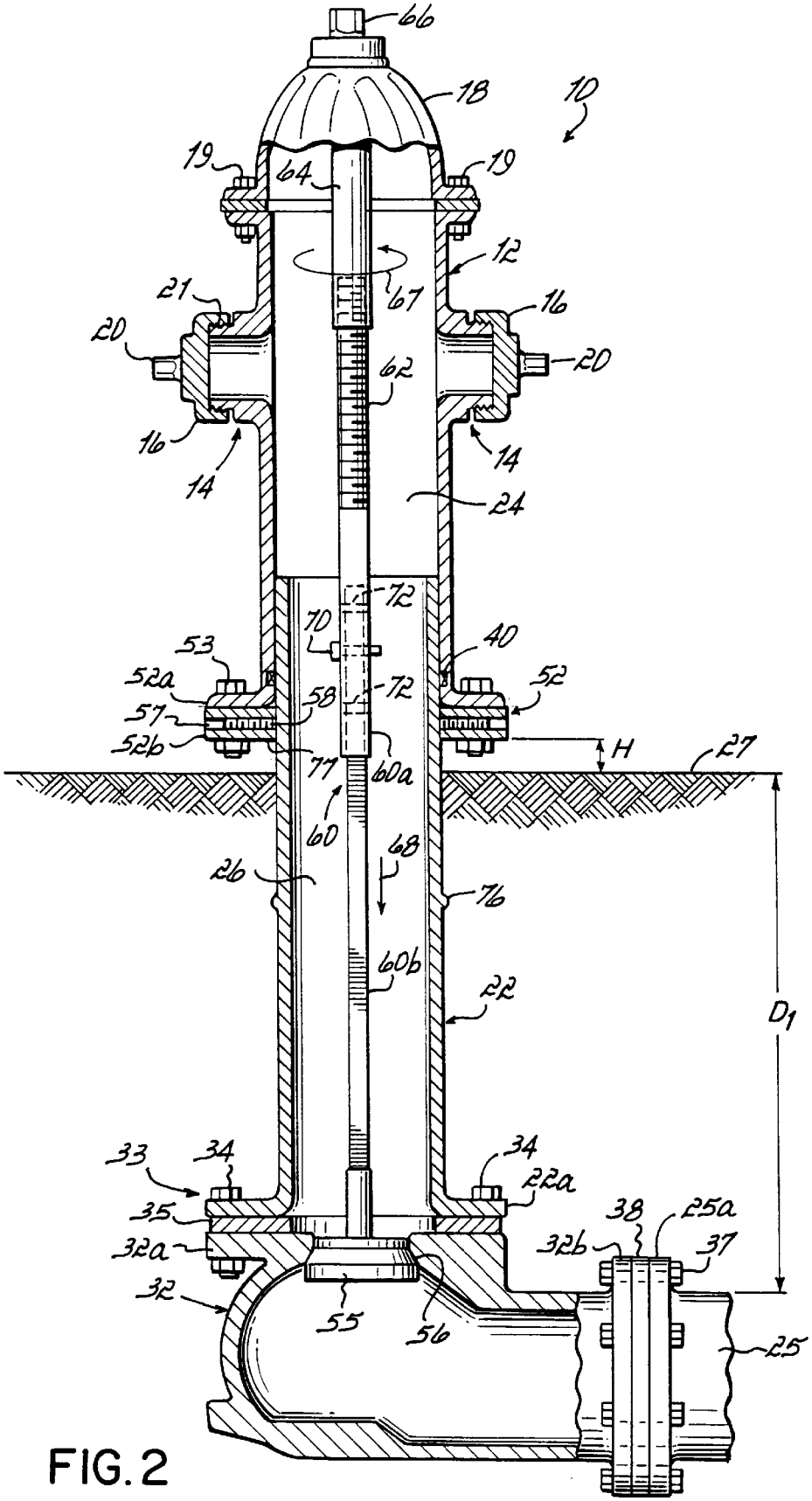
FIG. 2 is a side view, in partial cross-section, of the embodiment of FIG. 1 installed at a different depth.

Turning now to FIG. 2, the adjustment of the length of assembly 10 and the depth of the valve mechanism may be illustrated. Preferably, in accordance with the principles of the present invention, an adjustment of at least 18 inches in the length of the assembly 10 is preferably achievable, although shorter or longer length adjustments may also be utilized. To that end, the hydrant body section 12 and supply section 22 are dimensioned in length to provide preferably at least 24 inches of telescoping adjustment. However, it should be kept in mind that the water outlets 14 of the body section 12 should not be blocked by the inner supply section 22 when the assembly is at its shortest length. To that end, a stop structure 76 is formed on the supply section 22 to prevent over-insertion of the supply section into the hydrant body section 12. In the embodiment shown in FIG. 1, the stop structure 76 is an annular lip which projects radially outwardly from the outside surface of the supply section and has an outer diameter which is larger than the inner diameter of the body section 12. When the sections are telescoped together, the annular lip 76 will strike the bottom surface 77 of the locking flange mechanism 52 to prevent over-insertion of the supply section 22 into the body section 12. In that way, a portion of the body section will not extend in front of the outlets 14 of the hydrant body assembly to prevent the flow of water through the outlets when the assembly is at its shortest length.

The installation of FIG. 1 requires very little telescoping of the assembly 10, because the water main is at a first distance D1 below the ground surface 27. Once the transition section 32 is coupled to the water main 25, the telescoping sections 12, 22 are adjusted to the proper length for the installation. Simultaneously, the control stem sections 60*a*, 60*b* are also telescoped in length to provide proper placement and subsequent actuation of the valve mechanism. Once the proper length of the assembly 10 and valve control stem 60 are determined, the locking retainer mechanical flange assembly 52 is tightened to fix the length of the assembly after pin 70 is inserted into appropriately aligned passages 72 to lock the control stem 60 at a fixed length and to allow proper actuation of the valve seat 55 upon translation of the control stem 60. Preferably, the locking flange is positioned to achieve a certain clearance H above the ground surface 27 for tightening the locking flange mechanism 52. It will be understood that the length of the stem should be determined and fixed prior to assembly and fixing the length of the assembly, since it will be difficult to manipulate the control stem to change its length once the assembly 10 is put together.

The pin 70 and passages 72 of the control stem 60 provide incremental adjustments of the length of the control stem. In a preferred embodiment, the incremental adjustments are approximately one inch; that is, there is one inch between each of the passages within each of the sections of the control stem 60*a*, 60*b*. In that way, one inch incremental adjustments of the length of the control stem 60 may be achieved with the invention. Generally, one inch increment adjustments will be sufficient for suitable installation. Generally, the adjustability of length of the assembly 10 is continuous in nature, rather than incremental, and thus will provide a generally infinite adjustment range within a suitable distance, e.g., 24 inches. Prior art structures include only incremental add-on pieces that vary the length by 6 inches or 1 foot. Therefore, the present invention is a substantial improvement over the prior art and will provide a wide range of adjustment capabilities.

Turning to FIG. 2, use of the assembly for a water main 25 buried a greater distance D2 beneath the ground surface 27 is shown. For the greater depth D2, the supply section is telescoped away from the body section 12 to a greater depth. Control stem 60 is also telescoped to a suitable length for proper positioning of and operation of the valve mechanism. Pin 70 not only provides a fixation in the length of the control stem 60, but also locks the two sections 60*a*, 60*b* together so that they move as a single control stem 60 when translated by the rotating sleeve 64. At the proper length, the pin 70 is inserted and the locking flange mechanism 52 is tightened. Despite the variable depth of the buried water main 25, the hydrant body section 12 will maintain a generally fixed height or length above the ground surface 27, e.g., 32 inches. In the prior art, large variations of the above-ground height of hydrant body section 12 were necessary due to the fact that the depth of the water main was generally fixed and there was no way, outside of a 6 inch or 1 foot adjustment piece to install the assembly. As will be readily understood, the excess beyond the 6 inches or 1 foot required for the assembly appears above the ground surface 27 as an increased height of the hydrant body section, which is undesirable and which ruins the aesthetics of the hydrant installation. For example, if only a couple of inches extension is needed, the excess from the 6 inch or 1 foot appears aboveground as increased hydrant height.

Telescopic control stem 60 may be either rectangular or circular in cross-section, with the upper end having the thread 62 being circular in cross-section for proper operation with the cylindrically-shaped sleeve 64. The sleeve provides a suitable vertical translation of control stem 60 for proper opening and closing of the valve mechanism. Preferably, the hydrant assembly is constructed to meet the appropriate fire codes and ASTM standards, as will be readily understood.

Figure 3:
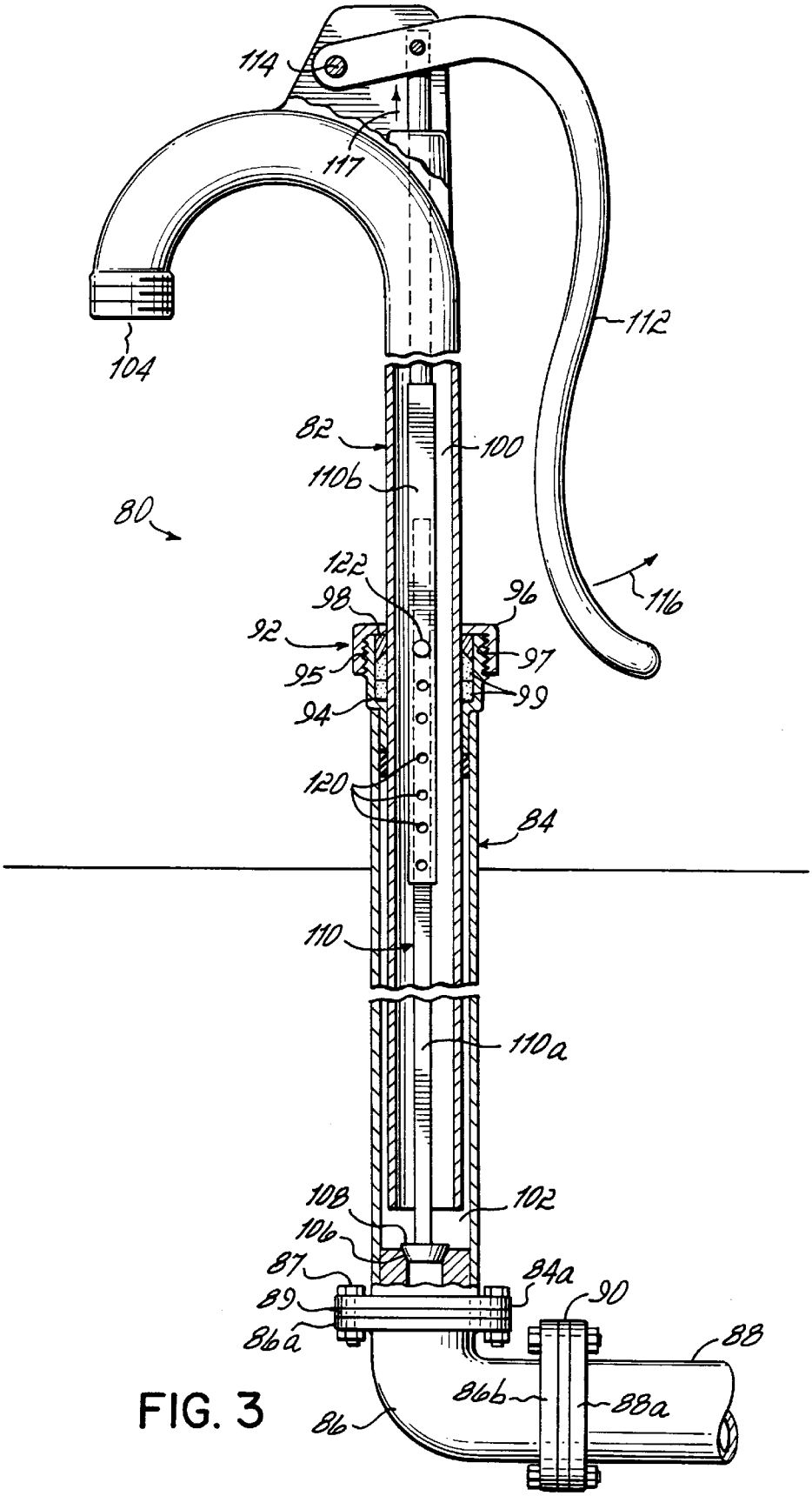
FIG. 3 is a side view, in partial cross-section, of another embodiment of the inventive water delivery assembly.

FIG. 3 shows an alternative embodiment of the present invention in the form of a faucet assembly 80 which includes a body section 82 and a supply section 84 which is in telescoping engagement with the body section 82. In that way, the length of the assembly may be adjusted for installations of different depths. At a buried end, body section 84 includes a flange 84*a* which is bolted to the flange 86*a* of a 90° transition section 86. The flanges and sections are held together by appropriate fasteners, such as bolts 87. The other end of the transition section includes another flange 86*b* which is coupled to an appropriate flange 88*a* of a buried water main 88. Gasket structures 89, 90 are utilized between the two joints for appropriate watertight sealing.

Section 82 telescopes within section 84 for varying the length of assembly 80. For fixing the length of the assembly, a sealing structure, such as a packing gland 92 might be utilized similar to the packing gland shown in FIG. 1A. That is, the packing gland 92 includes a seal seat section 94 formed with threads 95 and appropriately connected to the end of supply section 84. A rotating cap section 96 with corresponding threads 97 rotates to tighten down upon seat section 94 to compress a wedge gasket 98 against one or more sealing gaskets 99. This process, in turn, compresses the sealing gaskets 99 between the seat section 94 and the outside surface of body section 82 to seal the body section and supply sections together. Sealing structure 92 forms a watertight seal between the sections 82, 84. The sealing structure also provides friction between the telescoping sections to fix the length of the assembly 80 after the various telescoping sections 82, 84 have been adjusted to the desired length.

The various body sections of the assembly 80 include corresponding bores 100, 102 which cooperate to direct water from main 88 to a faucet outlet 104 when the valve of assembly 80 is opened. The valve mechanism of assembly 80 includes a valve seat 106 formed in one end of supply section 84 and a rubber valve stop 108 which moves toward and away from the valve seat 106 to open and close the valve mechanism and selectively allow water to be dispensed from the outlet 104.

A control stem 110 is coupled at one end to valve stop 108 for moving the valve stop and opening and closing the valve mechanism. The other end of control stem 110 is coupled to a handle mechanism 112 which, in turn, is coupled at a pivot point 114 to the body section 82. When handle 112 is lifted, as illustrated by reference arrow 116, the control stem is raised, as indicated by reference arrow 117 to raise the valve stop 108 and open the valve mechanism so that water may flow through the assembly, bores 100, 102, and through the water outlet 104. When the handle is lowered, the valve stop is again lowered into the valve seat to close the valve mechanism and thus stop the flow of water.

In accordance with the embodiment of the invention illustrated in FIG. 1, control stem 110 includes telescoping portions 110*a* and 110*b* which have a plurality of passages 120 formed therein which may be aligned for fixing the length of the control stem 110. Once aligned, a pin 122 is inserted through the aligned passages to fix the length of the control stem 110 to its desired length.

In that way, faucet assembly 80 may be adjusted to a variety of different lengths for attachment to water mains 88 which are buried at various depths. The control stem 110 telescopes with the assembly to maintain the valve at the deepest end of the assembly and, therefore, proximate the water main. In that way, the water is contained within the main and sufficiently below ground to prevent freezing.

The present invention thus addresses the varying installation conditions for an anti-freeze water delivery assembly by providing an adjustable assembly which may be suitably adjusted to various lengths. The present invention is easily and simply installed without extensive modifications, and maintains the position of the valve at a sufficient depth below the ground surface for freeze prevention. Generally, the sections of the assembly, such as the supply section as disclosed herein, may be manufactured in a variety of different lengths. However, the assembly sections will preferably be dimensioned to provide at least 18 inches of adjustable length. For example, an assembly might be made for adjustment between varying depths of 18 to 36 inches. Alternatively, the buried supply section of the assembly might be made at a longer length for buried depths which are adjustable between a length of 36 inches to 54 inches. Still further, and in accordance with the principles of the present invention, the buried supply section might be further lengthened for variable adjustment of the assembly between 42 inches and 60 inches. When the general depth of the water main has been ascertained, an appropriate assembly may be chosen and fine depth adjustments may be made in one inch increments, for proper installation. Furthermore, 24 inches may be rapidly and easily added or subtracted to adjust the length of the assembly without requiring new pipe sections or further attachment of extension sections.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. An adjustable anti-freeze water delivery assembly for connecting with a water main buried in the ground, the assembly comprising:

a body section having an inner bore and at least one water outlet in communication with the bore, the body section configured for being mounted generally above a ground surface;

a water supply section configured for coupling to a water main below the ground surface and having an inner bore, the body section and supply section being telescopically engaged for delivering water from the water main through said bores and to the water outlet and being operable for telescoping to selectively vary the length of the assembly;

a valve mechanism operably positioned proximate the supply section bore, the valve mechanism movable between an open and a closed position to control water flow therethrough;

a telescoping control stem extending between the body section and the valve mechanism and coupled to the valve mechanism for opening and closing the valve mechanism, the control stem including at least two telescoping portions which are slidably coupled together and being operable for telescoping in length when the assembly length is varied to maintain the valve mechanism proximate the supply section bore in various different assembly lengths so that when the valve mechanism is closed, water is contained at a sufficient depth below the ground surface to reduce the possibility of freezing in the assembly;

a securement structure coupled to secure said telescoping portions together at a particular length.

2. The assembly of claim 1 further comprising a nut structure coupled with said body section, the nut structure engaging said control stem and operable for moving the stem to open and close the pipe bore.

3. The assembly of claim 2 wherein said nut structure has a threaded bore which engages a threaded end of the control stem, rotation of the nut structure operably drawing the stem through the threaded bore to open and close the valve mechanism.

4. The assembly of claim 1 wherein the telescoping stem portions include holes therethrough which align at predetermined stem lengths, the securement structure including a pin for positioning in the holes to effectively fix the length of the stem at a predetermined length.

5. The assembly of claim 1 wherein the valve mechanism further comprises a valve stop and a valve seat positioned proximate the supply section bore, the valve stop alternatively movable against and away from said valve seat to close and open the valve.

6. The assembly of claim 1 further comprising a seal structure operably coupled between the body section and the water supply section for containing the water within the bores.

7. The assembly of claim 6 wherein said seal structure is a dynamic seal and is operable for sealing the body section and water supply section when the sections telescope to vary the length of the assembly.

8. The assembly of claim 1 further comprising a lever hingedly connected to the body section and coupled to said control stem, the stem moving when the lever is moved to open and close the valve mechanism.

9. An adjustable fire hydrant assembly for connecting with a water main buried in the ground, the fire hydrant assembly comprising:

a fire hydrant body section having an inner bore and at least one water outlet in communication with the bore, the body section configured for being mounted generally above a ground surface;

a water supply section configured for coupling to a water main below the ground surface and having an inner bore, the fire hydrant body section and supply section being coupled together for delivering water from the water main through said inner bores and to the water outlet and being operably coupled together for selectively varying the length of the assembly;

a valve mechanism operably positioned proximate the supply section, the valve mechanism movable between an open and a closed position to control water flow therethrough;

a telescoping control stem extending between the body section and the valve mechanism and coupled to the valve mechanism for opening and closing the valve mechanism, the control stem including at least two telescoping portions which are slidably coupled together and being operable for telescoping in length when the assembly length is varied to maintain the valve mechanism proximate the supply section bore in various different assembly lengths so that when the valve mechanism is closed, water is contained at a sufficient depth below the ground surface to reduce the possibility of freezing in the assembly;

a securement structure coupled to secure said telescoping portions together at a particular length.

10. An adjustable waterfaucet assembly for connecting with a water main buried in the ground, the fire hydrant assembly comprising:

a faucet section having an inner bore and at least one water outlet in communication with the bore, the body section configured for being mounted generally above a ground surface;

a water supply section configured for coupling to a water main below the ground surface and having an inner bore, the faucet body section and supply section being coupled together for delivering water from the water main through said inner bores and to the water outlet and being operably coupled together for selectively varying the length of the assembly;

a valve mechanism operably positioned proximate the supply section, the valve mechanism movable between an open and a closed position to control water flow therethrough;

a telescoping control stem extending between the body section and the valve mechanism and coupled to the valve mechanism for opening and closing the valve mechanism, the control stem including at least two telescoping portions which are slidably coupled together and being operable for telescoping in length when the assembly length is varied to maintain the valve mechanism proximate the supply section bore in various different assembly lengths so that when the valve mechanism is closed, water is contained at a sufficient depth below the ground surface to reduce the possibility of freezing in the assembly;

a securement structure coupled to secure said telescoping portions together at a particular length;

a lever hingedly coupled to the body section and coupled to the control stem, the stem moving when the lever is moved to open and close the valve mechanism.

* * * * *